US009204731B2

(12) United States Patent
Corodemus et al.

(10) Patent No.: US 9,204,731 B2
(45) Date of Patent: Dec. 8, 2015

(54) BEDDING PRODUCTS HAVING FLEXIBLE GEL PANELS

(71) Applicant: Comfort Revolution, LLC, West Long Beach, NJ (US)

(72) Inventors: Dimitrios S. Corodemus, West Long Branch, NJ (US); Michael Fux, Monmouth Beach, NJ (US)

(73) Assignee: Comfort Revolution, LLC, West Long Branch, NJ (US)

( * ) Notice: Subject to any disclaimer, the term of this patent is extended or adjusted under 35 U.S.C. 154(b) by 0 days.

(21) Appl. No.: 13/754,496

(22) Filed: Jan. 30, 2013

(65) Prior Publication Data

US 2014/0208518 A1 Jul. 31, 2014

Related U.S. Application Data

(60) Provisional application No. 61/757,115, filed on Jan. 26, 2013, provisional application No. 61/592,396, filed on Jan. 30, 2012.

(51) Int. Cl.

| | |
|---|---|
| ***A47C 27/08*** | (2006.01) |
| ***A47C 27/16*** | (2006.01) |
| ***A61G 7/057*** | (2006.01) |
| *A47G 9/02* | (2006.01) |
| *A47G 9/00* | (2006.01) |
| *A47G 9/10* | (2006.01) |

(52) U.S. Cl.

CPC ..... *A47C 27/085* (2013.01); *A47C 27/16* (2013.01); *A47G 9/0246* (2013.01); *A61G 7/05738* (2013.01); *A47G 9/0253* (2013.01); *A47G 9/1036* (2013.01); *A47G 2009/008* (2013.01)

(58) Field of Classification Search

CPC .... A47C 27/085; A47C 27/15; A47C 27/146; A47C 27/148; A47C 27/142; A47C 27/144; A47C 27/16; Y10S 5/909; A47G 2009/008; A47G 9/0246; A47G 9/1036; A47G 9/0253; A61G 7/05715; A61G 7/05738

USPC ..... 5/485, 486, 490, 499, 500, 502, 654, 5/655.5, 948; 428/70, 71, 167

See application file for complete search history.

(56) References Cited

U.S. PATENT DOCUMENTS

| | | | | | |
|---|---|---|---|---|---|
| 2,575,764 | A | * | 11/1951 | Morner | 428/72 |
| 3,663,973 | A | * | 5/1972 | Spence | 5/655.5 |
| 4,788,730 | A | * | 12/1988 | Bexton | 5/676 |
| 5,152,023 | A | * | 10/1992 | Graebe | 5/655.3 |
| 5,243,722 | A | * | 9/1993 | Gusakov | 5/655.3 |
| 5,590,430 | A | * | 1/1997 | Sereboff | 5/655.5 |
| 5,636,395 | A | * | 6/1997 | Serda | 5/691 |
| 5,701,621 | A | * | 12/1997 | Landi et al. | 5/691 |
| 5,881,409 | A | * | 3/1999 | Pearce | 5/702 |

(Continued)

*Primary Examiner* — Nicholas Polito
*Assistant Examiner* — David R Hare
(74) *Attorney, Agent, or Firm* — Doherty IP Law Group LLC

(57) ABSTRACT

A bedding product, such as a mattress, mattress topper, or pillow case, includes a flexible gel panel having a cured gel layer with a top surface and a bottom surface, a flexible top layer overlying the top surface of the cured gel layer, and a fabric bottom layer overlying the bottom surface of the cured gel layer. The bedding product has a major surface and the flexible gel panel is integrated into the bedding product so that the flexible top layer of the flexible gel panel is juxtaposed with the major surface of the bedding product. The flexible gel panel is removable from the bedding product for laundering the bedding product.

20 Claims, 20 Drawing Sheets

(56) References Cited

U.S. PATENT DOCUMENTS

| | | | | |
|---|---|---|---|---|
| 6,226,820 | B1 * | 5/2001 | Navarro | 5/655.5 |
| 6,393,640 | B1 * | 5/2002 | Dalis | 5/497 |
| 6,677,026 | B1 * | 1/2004 | Yates | 428/137 |
| 6,880,190 | B2 * | 4/2005 | Danino Inchaustegui | 5/683 |
| 6,996,864 | B2 * | 2/2006 | Call | 5/653 |
| 7,444,703 | B2 * | 11/2008 | Jansen | 5/710 |
| 7,669,552 | B2 * | 3/2010 | Arvanites | 119/28.5 |
| 7,921,807 | B2 * | 4/2011 | Arvanites | 119/28.5 |
| 8,307,482 | B2 * | 11/2012 | Gladney et al. | 5/727 |
| 2004/0010853 | A1 * | 1/2004 | Muci et al. | 5/644 |
| 2005/0223667 | A1 * | 10/2005 | McCann et al. | 52/403.1 |
| 2006/0123548 | A1 * | 6/2006 | Heath | 5/644 |
| 2007/0226911 | A1 * | 10/2007 | Gladney et al. | 5/691 |
| 2010/0237082 | A1 * | 9/2010 | Fernandez | 220/592.17 |

* cited by examiner

BEDDING PRODUCTS HAVING FLEXIBLE GEL PANELS

CROSS REFERENCE TO RELATED APPLICATIONS

The present application claims benefit of U.S. Provisional Application No. 61/757,115, filed Jan. 26, 2013, entitled 'COOLING GEL PANELS INCORPORATED INTO PILLOW CASES, MATTRESSES AND MATTRESS TOPPERS", and U.S. Provisional Application No. 61/592,396, filed Jan. 30, 2012, entitled "GEL PANELS FOR USE WITH MATTRESSES AND MATTRESS TOPPERS", the disclosures of which are hereby incorporated by reference herein.

BACKGROUND OF THE INVENTION

Field of the Invention

The present application is generally related to sleep products including mattresses, mattress toppers and pillows, and is more specifically related to mattresses, mattress toppers and pillows containing gels utilized for providing a cool sleeping surface. The present application is also related to pillow covers having gel layers for providing cool sleeping surfaces for pillows.

SUMMARY OF THE INVENTION

In one embodiment, the present application includes a flexible gel panel disposed atop a mattress of a bed. In one embodiment, the gel panel may be placed atop a mattress and under a fitted sheet secured over the mattress. In one embodiment, the flexible gel panel may be sewn into or incorporated into a bed covering such as a mattress topper or a fitted sheet. In one embodiment, the flexible gel panel may be incorporated into a pillow or a pillow case.

In one embodiment, a gel panel includes a cured gel layer that is disposed between a flexible top layer and a fabric bottom layer. The gel layer preferably includes one or more well-known gel materials such as a polyether gel that is cured and bonded to the top layer and the bottom layer.

In one embodiment, the flexible top layer is a TPU film (e.g., a polyurethane film), such as that sold by American Polyfilm, Inc. of Branford, Conn.. The TPU film may be provided on rolls. In one embodiment, the TPU film has a thickness of about 1 mil, and a width of up to 70 inches or more.

The TPU film preferably exhibits a polyurethane film's mechanical properties such as high durability, abrasion resistance, and low temperature flexibility.

In one embodiment, the fabric bottom layer may be a flexible fabric. In one embodiment, the fabric bottom layer is a four way stretchable non-woven fabric. Decorative borders, trim, quilting and other features and options may be used to enhance the aesthetics and "hand" of the product.

In one embodiment, the flexible gel panel includes a clear top layer, a central gel layer, and a fabric bottom layer. The clear top layer and the fabric bottom layer are desirably bonded to the gel layer during curing of the gel layer. The assembled gel panel may be sewn into a finished cover. The cover may include a gusset, a false gusset, a zippered removable insert, and/or a "skirt" that is adapted to stretch down and around a mattress.

In one embodiment, the bottom layer may include a phase change fabric such as that sold by Outlast. In one embodiment, the fabric bottom layer may include a lightweight fabric and/or a mesh fabric to allow for maximum cooling benefit.

In one embodiment, a single gel panel or a series of gel panels may be incorporated into a single unit. The configuration and size of a flexible gel panel may be modified to accommodate beds having different sizes such as Extra Twin—75"×39"; Full—75"×54"; Queen—80"×60"; King—80"×76"; and California King—84"×72".

The flexible gel panels may be fabricated and/or modified to accommodate various percentages of a surface area, i.e. the entire surface, a partial surface area, a single zone of a surface area, or multiple zones of a surface area.

In one embodiment, the flexible gel panel has a thickness of about 0.1-10 mm, which may be determined by the depth of the mold that is used for fabricating the gel panel.

Although the present invention is not limited by any particular theory of operation, it is believed that incorporating flexible gel panels into sleep products provides a cooler surface temperature for an extended period of time, which enables more restful and rejuvenating sleep. Many sleep products now incorporate memory foam. Studies have shown that memory foam is in insulator. As a result, memory foam products are typically known as having "hot" sleep surfaces. The present invention incorporates a flexible gel panel into a memory foam topper or mattress, or a gel panel may be used as a stand-alone unit to provide an initially cooler sleep surface to assist a user in falling asleep more easily.

As documented in Example 1 below, during use, sleep products having flexible gels or flexible gel pads incorporated therein take longer to warm. In fact, as shown in Example 1, when a gel topper or gel panel is used in combination with a foam pad or on top of other materials, it takes up to 5.5 times longer for the gel to warm to temperature levels when compared to sleep products in which gels are not utilized.

In one embodiment, the flexible gel panel may be removed from the sleep product such as a mattress topper or pillow case so that the sleep product may be laundered. After the sleep product is laundered, the flexible gel panel may be re-inserted into the sleep product. In one embodiment, the sleep product may include one or more fasteners that may be opened for removing the gel panel prior to laundering the sleep product. After the gel panel has been re-inserted back into the laundered sleep product, the one or more fasteners may be closed. The one or more fasteners that may be used include zippers, Velcro® fasteners, buttons, hooks, stitching and/or thread.

In December 2011, the Dr. Oz Show profiled one of Applicant's products as being a Top 12 healthy item for use in 2012. Dr. Oz selected a memory foam pillow with a gel panel because its use promoted better sleep and a healthier lifestyle.

Dr. Oz stated that research has indicated that sleep deprivation causes weight gain. In particular, decreased sleep activates a hormone that increases appetite. Obtaining an appropriate amount of sleep can burn up to 300 more calories per night. That equates to about 30 lbs in a year.

During another program, Dr. Oz introduced a sleep doctor, Dr. Michael Breus, author of a book entitled, "The Sleep Doctor's Diet Plan." Dr. Breus explained that there is a direct relationship between sleep and weight control. A lack of sleep causes an increase in cortisol production and an increase in appetite. An increase in cortisol levels also makes individuals crave high carbohydrate and high fat foods. Less sleep also results in individuals having less REM sleep, which is the type of sleep during which most calories are burned. Dr. Breus also talked about other hormones related to lack of sleep and concluded with a statement that there are many reasons why sleep and weight control are directly related. Dr.

Oz stated, "I did the math and if you can increase just one hour a night of sleep (from 7 to 8 hours) you'd lose 14 lbs in a year."

Although the present invention is not limited by any particular theory of operation, it is believed that providing a cooler sleep surface using a gel layer will enable individuals to fall asleep faster, which will allow the body to sleep more, and help individuals lose weight.

These and other preferred embodiments of the present invention will be described in more detail below.

DETAILED DESCRIPTION

Figure 1:
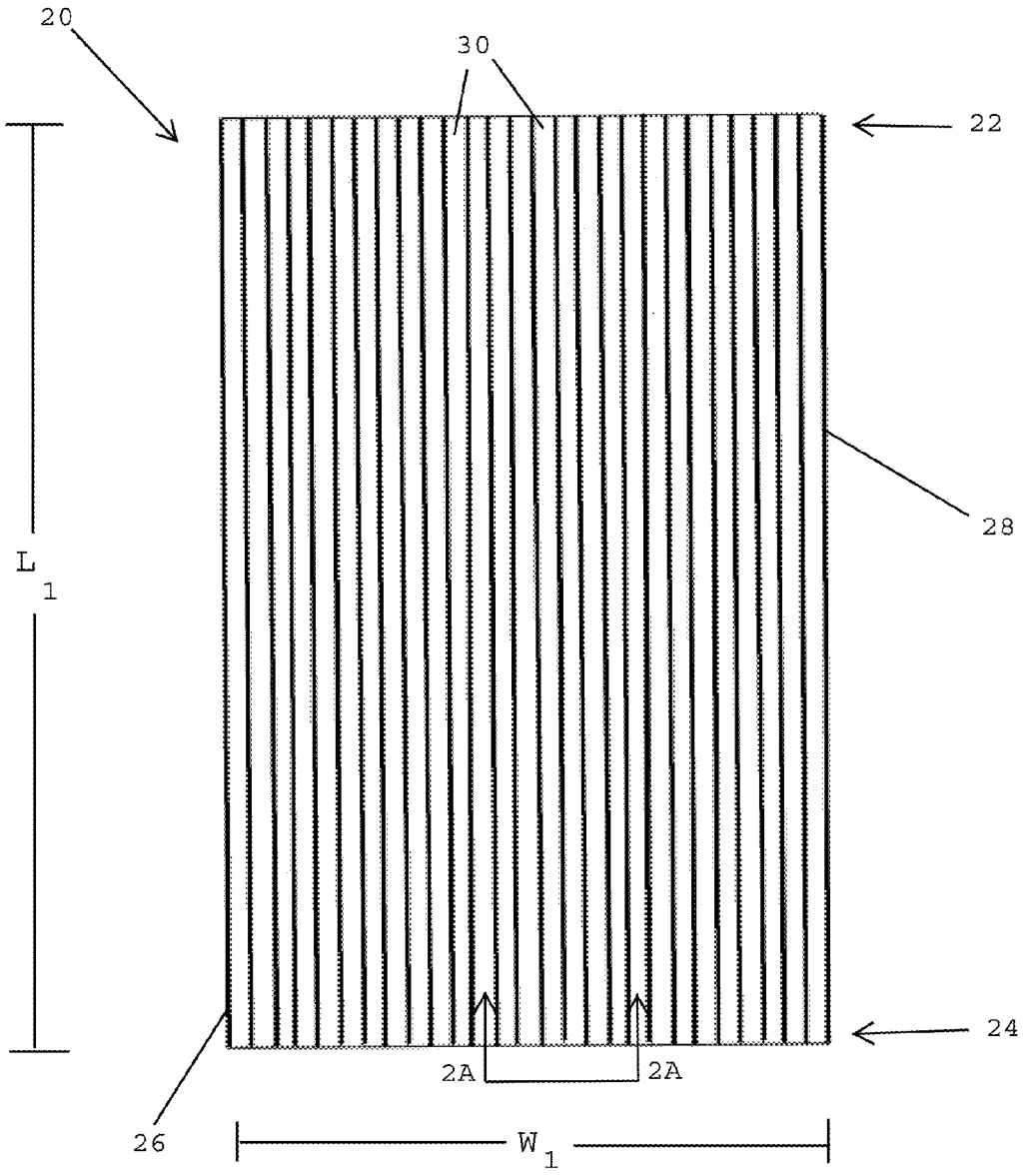
FIG. 1 shows a top plan view of a first mold part used for making a flexible gel panel, in accordance with one embodiment of the present invention.

Referring to FIG. 1, in one embodiment, a mold for making a flexible gel panel for sleep products preferably includes a first mold part 20 having a first end 22, a second end 24, and a length $L_1$ extending between the first and second ends. The first mold part 20 also has side edges 26, 28 that define a width $W_1$. In one embodiment, the length $L_1$ is about 4-10 feet and the width $W_1$ is about 3-6 feet.

Figure 2A:
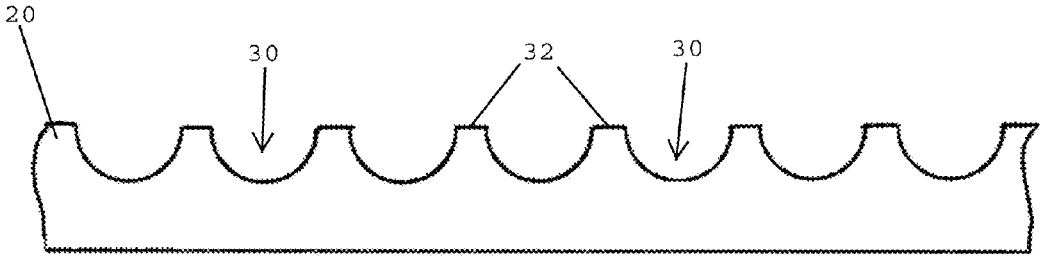
FIGS. 2A-2F show a method of making a flexible gel panel, in accordance with one embodiment of the present invention.

Referring to FIGS. 1 and 2A, the first mold part 20 includes a plurality of grooves 30 that extend along the length of the mold. In one embodiment, the grooves 30 have a semi-circular shape. The first mold part 20 also has flat surfaces 32 disposed between the grooves 30. The flat surfaces 32 are preferably co-planar and extend along the length $L_1$ of the first mold part 20.

In one embodiment, the grooves 30 of the mold may have other shapes such as square, circular, triangular, or other geometric shapes or patterns. In one embodiment, the grooves 30 of the mold may be multi-dimensional.

Figure 2B:
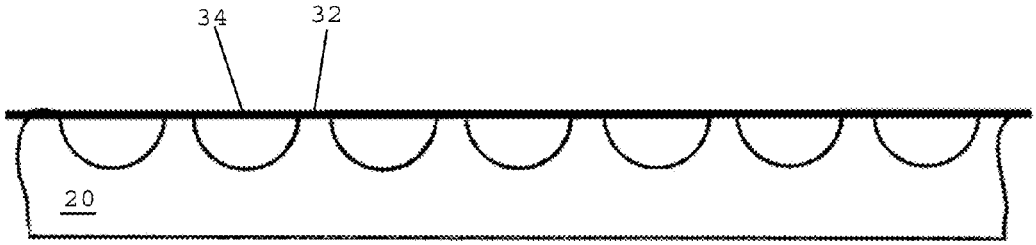
Figure 2C:
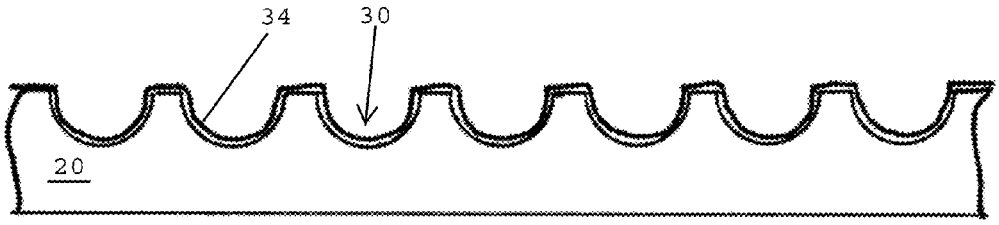

Referring to FIG. 2B, in one embodiment, a TPU film 34 is disposed over the flat surfaces 32 of the first mold part 20. Referring to FIG. 2C, heat and/or vacuum may be applied for collapsing the TPU film 34 into the grooves 30 of the first mold part 20 so that the TPU film conforms to the shape of the grooved face of the first mold part 20.

Figure 2D:
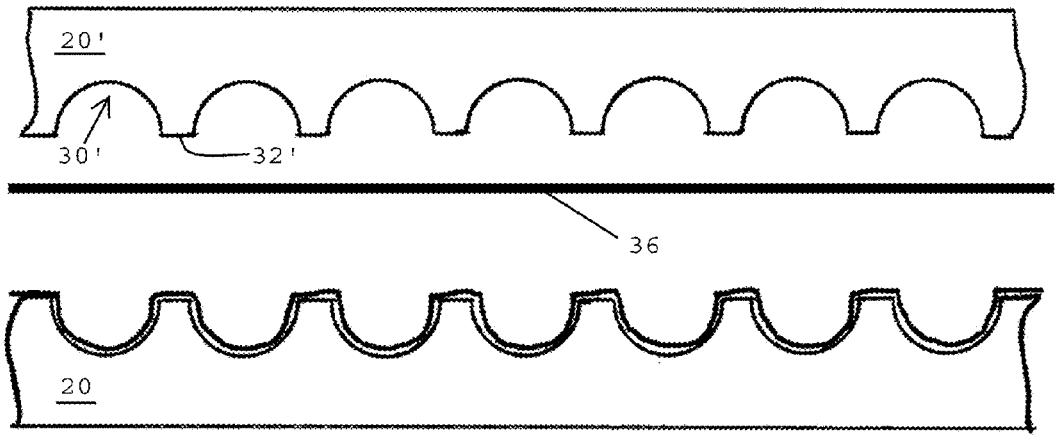

Referring to FIG. 2D, a second mold part 20' is juxtaposed with the first mold part 20. The second mold part 20' preferably mirrors the first mold part 20. In one embodiment, the second mold part 20' includes a plurality of elongated grooves 30' and flat surfaces 32' that extend between the elongated grooves 30'. A flexible fabric sheet 36, such as a four way stretchable sheet of fabric, is preferably disposed between the opposing grooved faces of the first and second mold parts 20, 20'.

Figure 2E:
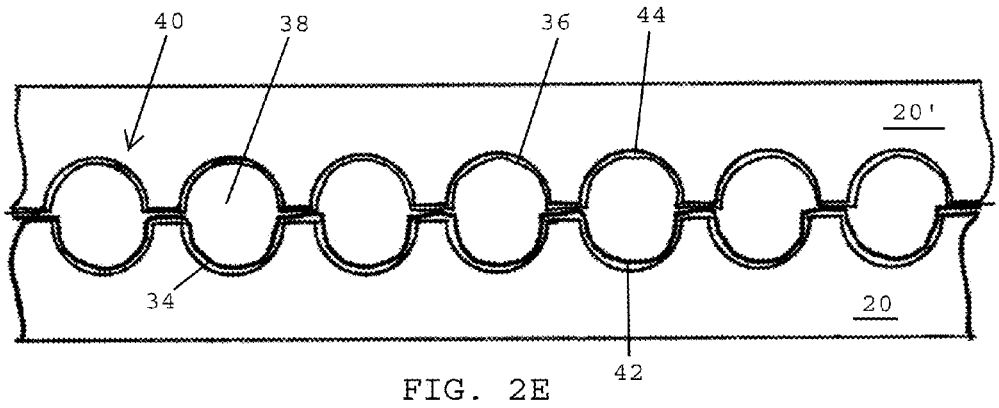

Referring to FIG. 2E, in one embodiment, a layer of a curable gel 38, such as a polyether gel, is provided over the TPU film 34. In one embodiment, the curable gel is dispensed over the first mold part 20. In another embodiment, the curable gel may be injection molded between the first and second mold parts 20, 20'.

In one embodiment, the first and second mold parts 20, 20' are closed, whereby the fabric sheet 36 conforms to the shape of the grooved face of the second mold part 20'. Heat and pressure are preferably applied to the laminate through the first and second mold parts 20, 20' to form a flexible gel panel 40 including a TPU film 34, a gel layer 38, and a flexible fabric layer 36. The flexible gel panel 40 preferably has a first surface 42 that conforms to the grooved face of the first mold part 20 and a second surface 44 that conforms to the grooved face of the second mold part 20'.

In one embodiment, the second mold part 20' is not used. After the gel is dispensed atop the first mold part 20, the fabric layer 36 is placed over the top surface of the gel material and the gel is cured, whereby the fabric layer 36 is bonded to the top surface of the gel layer. The fabric layer 36 preferably conforms to the shape of the cured gel layer for mirroring the shape of the cured gel layer.

Figure 2F:
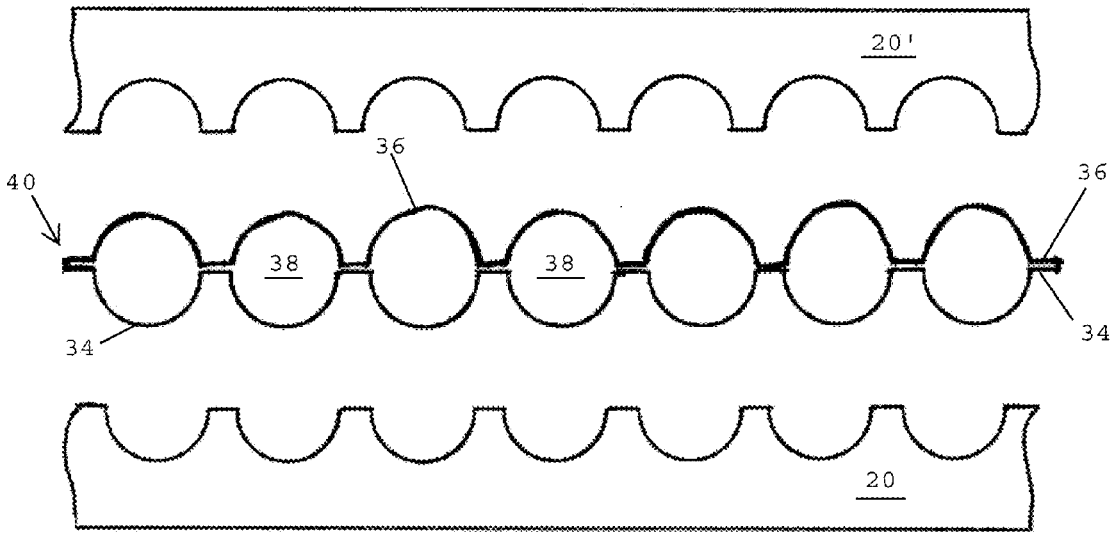
Figure 3:
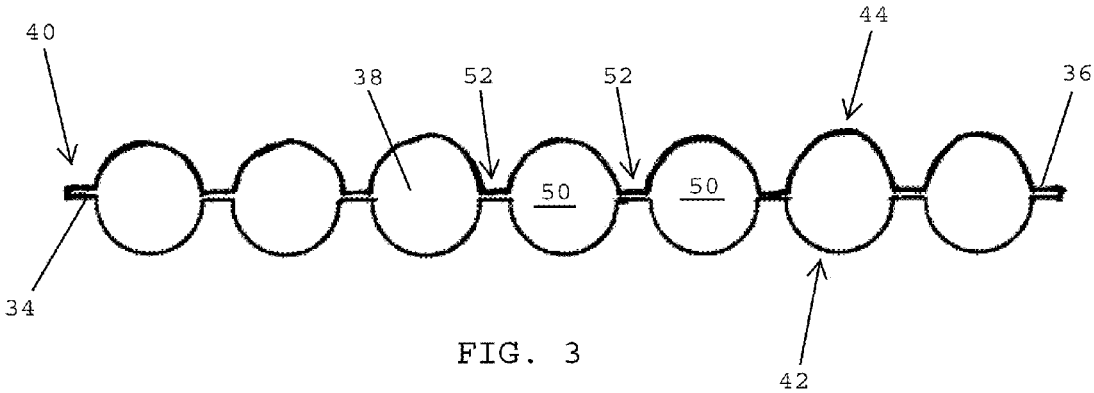
FIG. 3 shows a cross-sectional view of a flexible gel panel, in accordance with one embodiment of the present invention.

Referring to FIG. 2F, after sufficient levels of heat and pressure have been applied to the laminate, the first and second mold parts 20, 20' may move away from one another for opening the mold. Referring to FIGS. 2F and 3, the flexible gel panel 40 including the TPU film 34, the gel layer 38, and the fabric layer 36 is removed from the mold. The first surface 42 of the gel panel 40 is covered by the TPU film 34 and the second surface 44 of the gel panel 40 is covered by the flexible fabric 36.

Figure 4A:
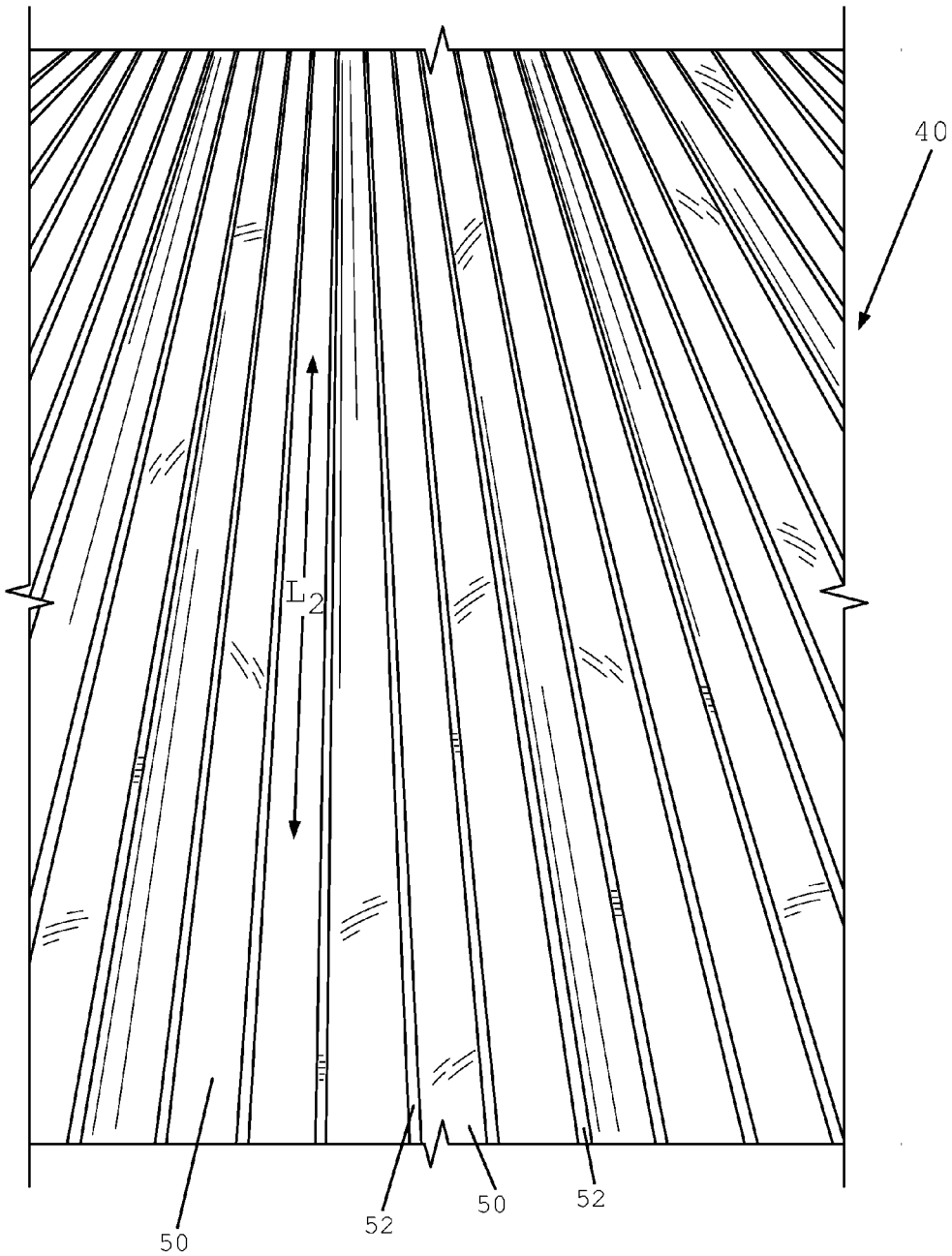
FIG. 4A shows a perspective view of a first surface of a flexible gel panel, in accordance with one embodiment of the present invention.

Referring to FIGS. 3 and 4A, the gel layer 38 of the flexible gel panel 40 includes a plurality of elongated gel tubes 50 that extend along the length $L_2$ of the panel. The gel tubes 50 are connected to one another by gel filled valleys 52 that extend between the gel tubes 50. The gel tubes 50 and gel valleys 52 cooperate to form the continuous gel panel 40 having a wave configuration. When the flexible gel panel 40 is positioned atop a mattress, the first surface 42 that is covered by the TPU film 34 preferably faces upward for being contacted by an individual sleeping on the mattress. In the embodiment shown in FIG. 4A, the TPU film 34 is transparent.

Figure 4B:
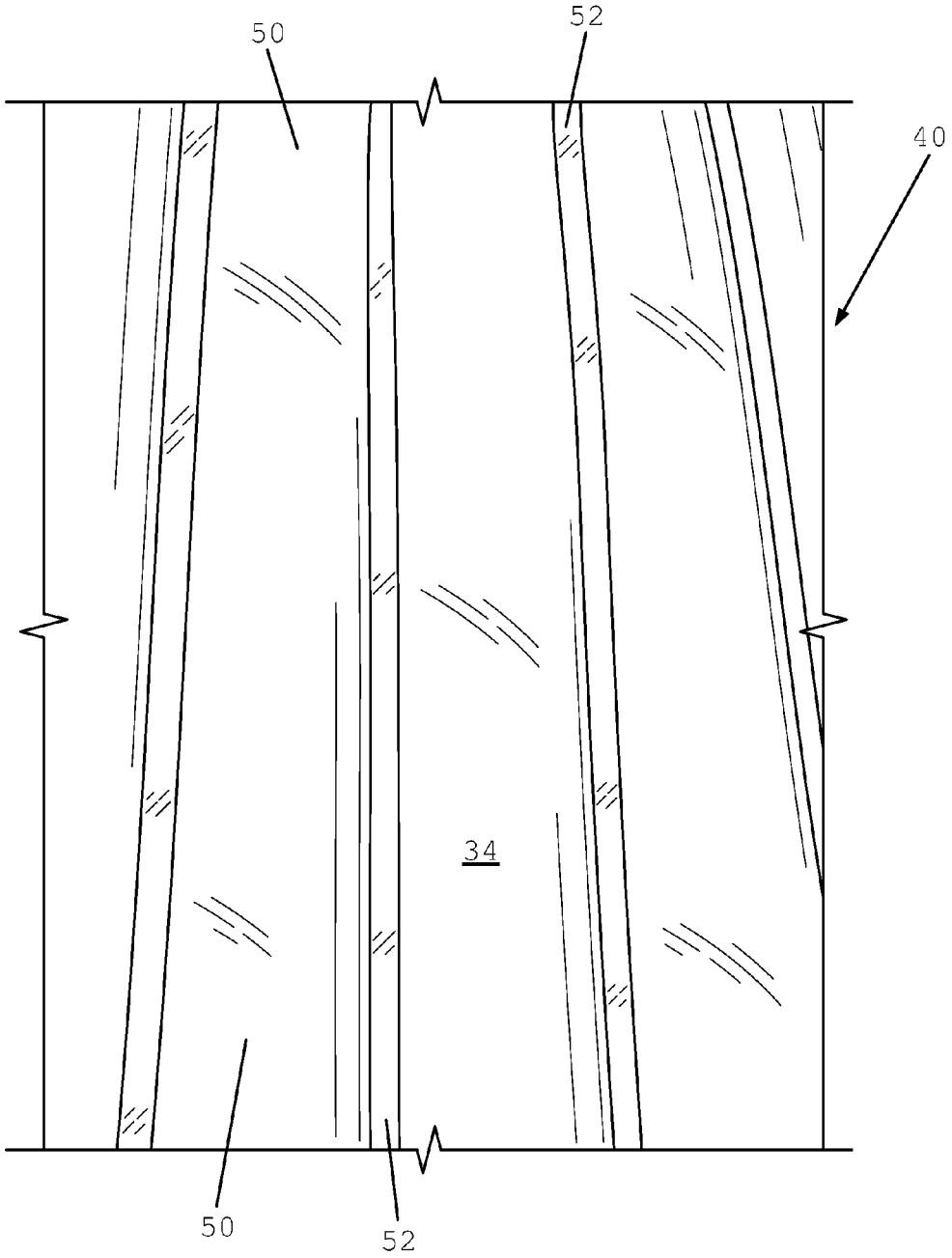
FIG. 4B shows a magnified view of the first surface of the flexible gel panel shown in FIG. 4A.

FIG. 4B shows a magnified view of the flexible gel panel 40 shown in FIG. 4A. The flexible gel panel 40 includes a transparent TPU film 34 covering the gel tubes 50 and the gel depressions 52 between the gel tubes. The transparent TPU film desirably covers the first surface 42 of the gel panel 40, which desirably faces individuals lying atop the bed for providing a cool sleeping surface.

One embodiment of the present invention discloses gel that is arrayed as elongated gel tubes. In other embodiments, however, the gel of the gel panel may have a different pattern or shape, such as a square pattern or shape, a circular pattern or shape, a multi-dimensional pattern or shape, or other geometric patterns or shapes (e.g. triangular).

Figure 4C:
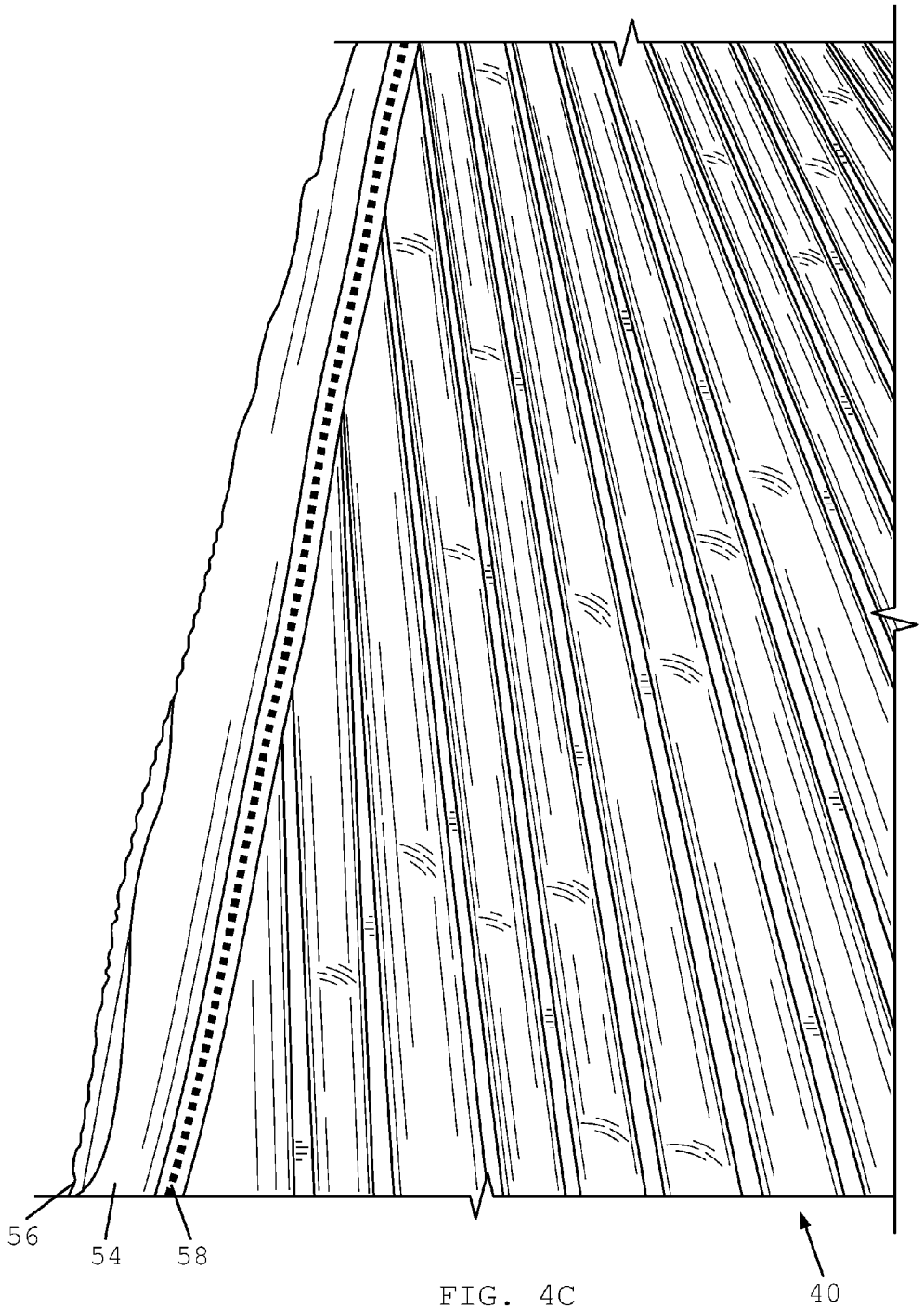
FIG. 4C shows a flexible gel panel sewn into a bedding product, in accordance with one embodiment of the present invention.

Referring to FIG. 4C, in one embodiment, the flexible gel panel 40 is sewn to a sheet of fabric 54 having and outer edge 56 with a zipper 58. The flexible gel panel 40 may be inserted into a sleep product, such as a mattress topper. The zipper 58 may be closed for securing the gel panel 40 to the mattress topper. If the mattress topper needs laundering, the zipper 58 may be opened for removing the gel panel 40 from the mattress topper.

Figure 5A:
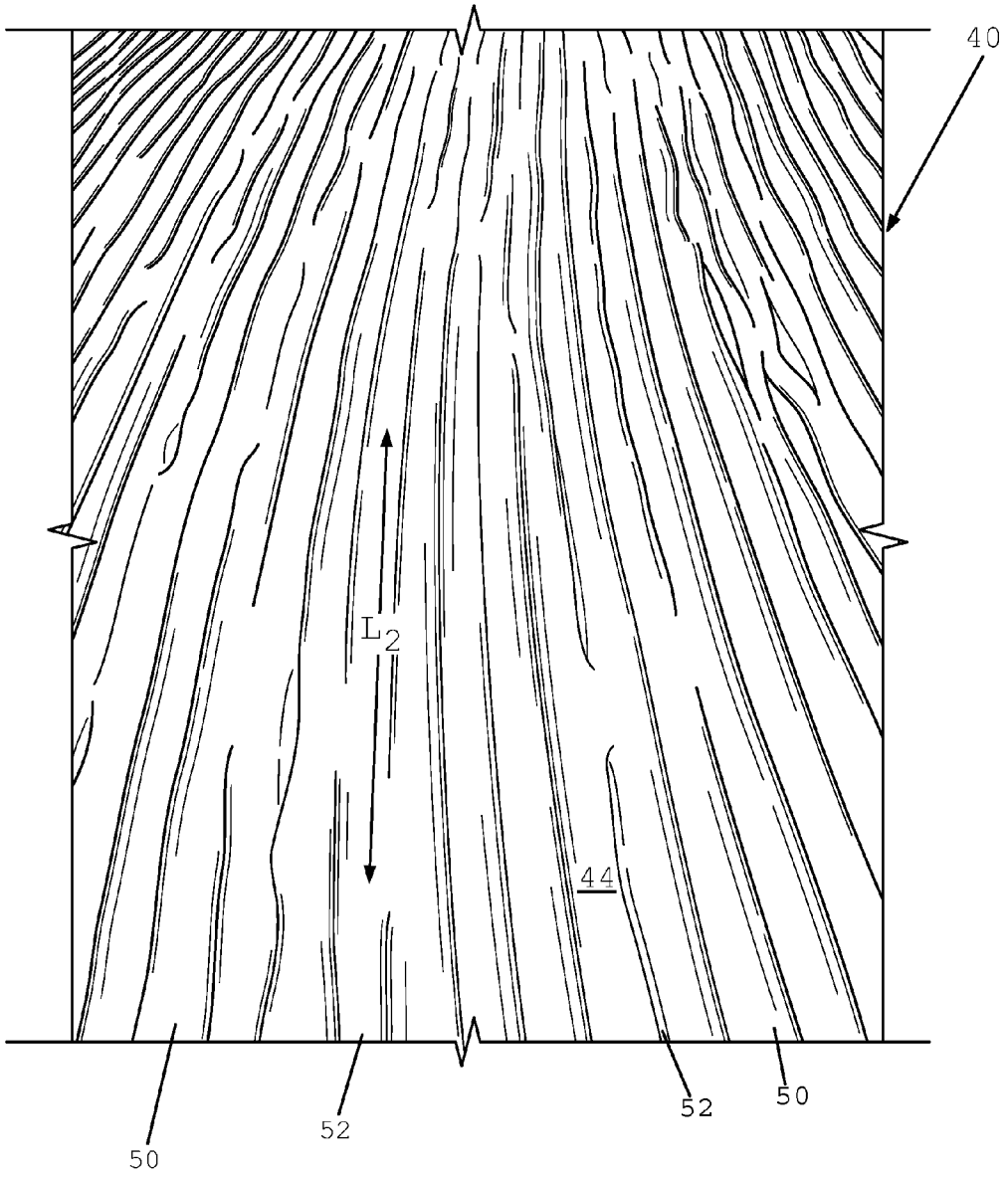
FIG. 5A shows a perspective view of a second surface of a flexible gel panel, in accordance with one embodiment of the present invention.
Figure 5B:
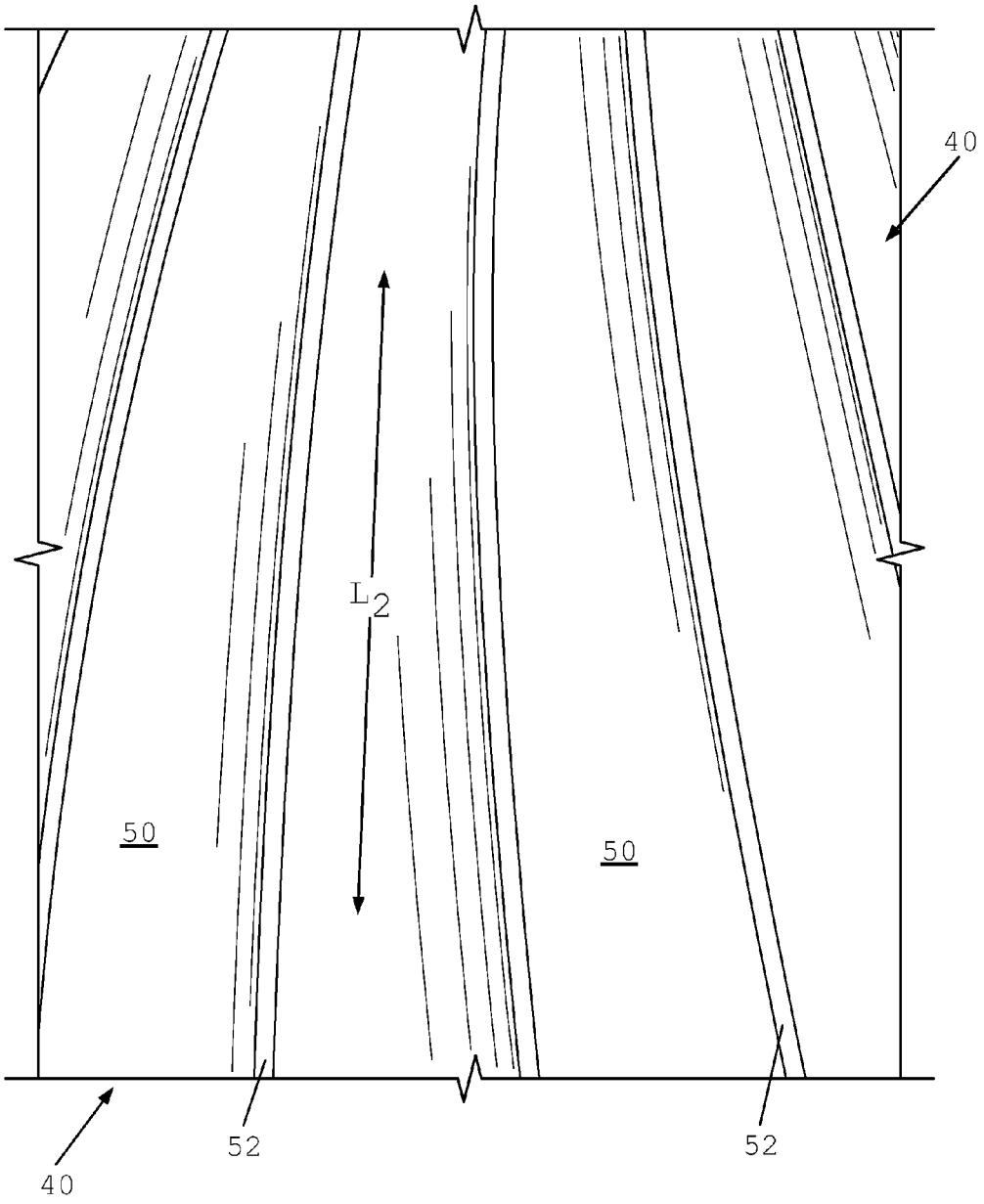
FIG. 5B shows a magnified view of a second surface of the flexible gel panel shown in FIG. 5A.

FIGS. 5A and 5B show the second surface 44 (FIG. 3) of the gel panel 40. The flexible fabric 36, accessible at the second surface 44, conforms to the shape of the gel tubes 50 and the gel valleys 52 that interconnect the gel tubes 50. The gel tubes 50 and the gel valleys 52 preferably extend along the length $L_2$ of the flexible gel panel 40. When the gel panel 40 is positioned atop a mattress, the second surface 44 of the gel panel 40 desirably faces toward the mattress.

Figure 5C:
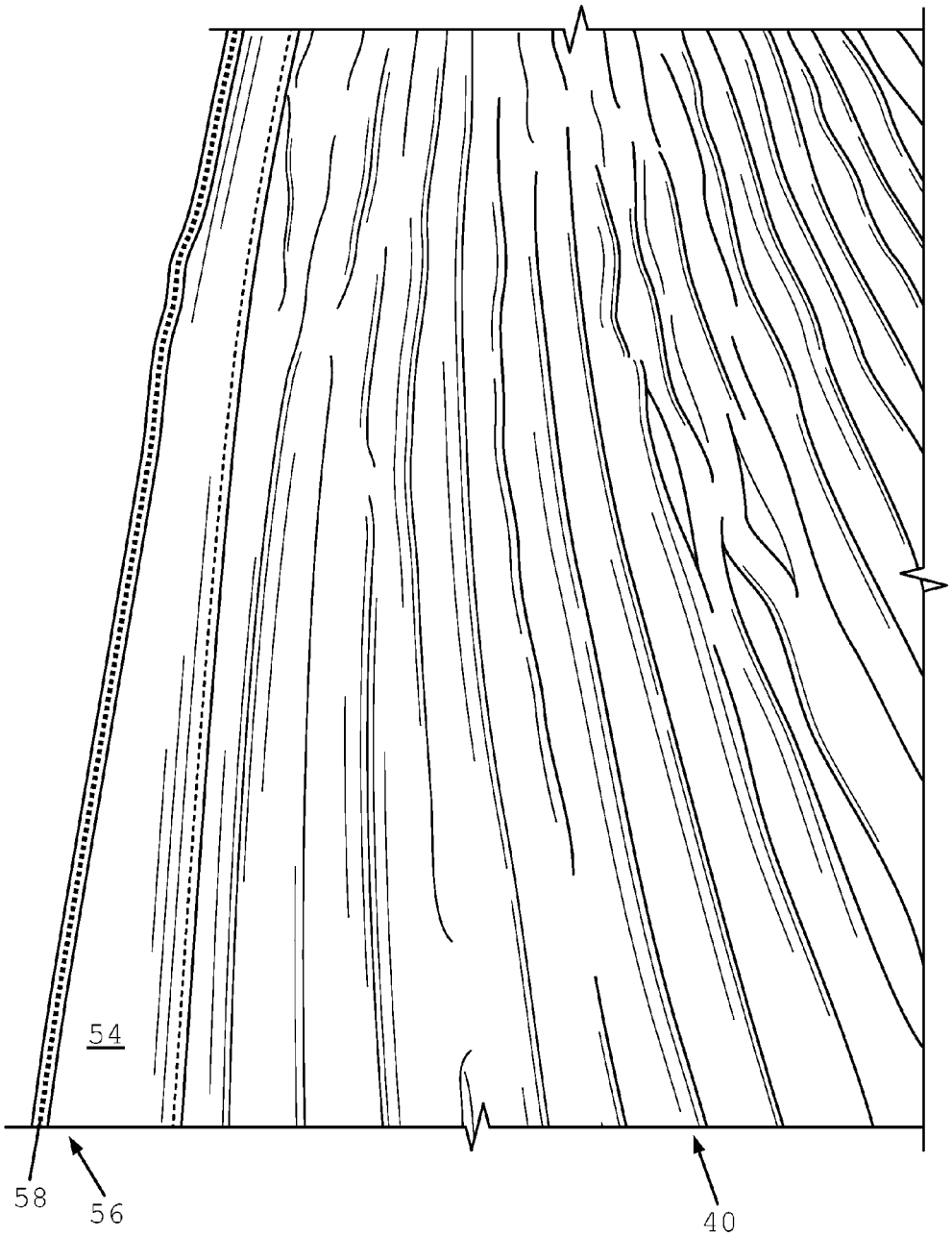
FIG. 5C shows a flexible gel panel sewn into a bedding product, in accordance with one embodiment of the present invention.

Referring to FIG. 5C, in one embodiment, the flexible gel panel 40 is sewn to the sheet of fabric 54 having the outer edge 56 with the zipper 58. The flexible gel panel 40 may be inserted into a sleep product, such as a mattress topper. The zipper 58 may be closed for securing the gel panel 40 to the mattress topper. As described above, if the mattress topper needs laundering, the zipper 58 may be opened for removing the gel panel 40 from the mattress topper. The gel panel 40 may be re-inserted into the mattress topper after laundering.

Figure 6:
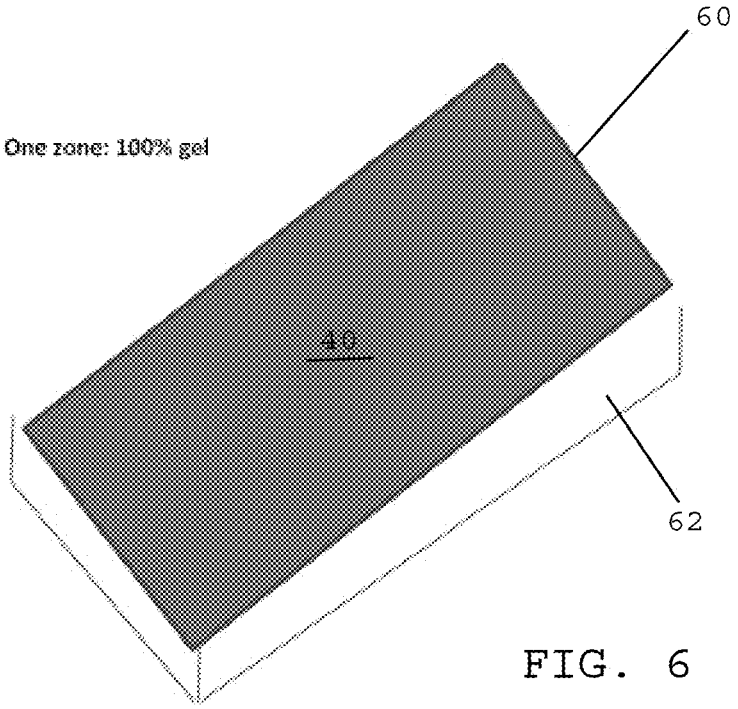
FIG. 6 shows a bedding product including a flexible gel panel that covers 100% of the top surface of a mattress, in accordance with one embodiment of the present invention.

Referring to FIG. 6, in one embodiment, a sleep product 60, such as a mattress topper, may include a flexible gel panel 40 that covers 100% of the surface area of a mattress 62.

Figure 7:
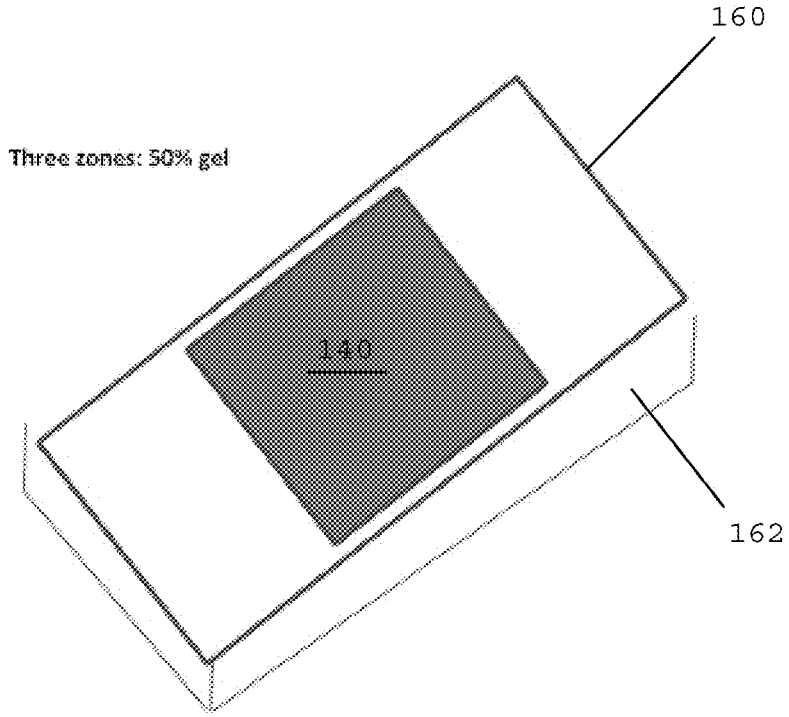
FIG. 7 shows a bedding product including a flexible gel panel that covers 50% of the top surface of a mattress, in accordance with one embodiment of the present invention.

Referring to FIG. 7, in one embodiment, a sleep product 160, such as a mattress topper, may have three zones whereby one of the zones of a mattress 162 is covered by a flexible gel panel 140.

Figure 8:
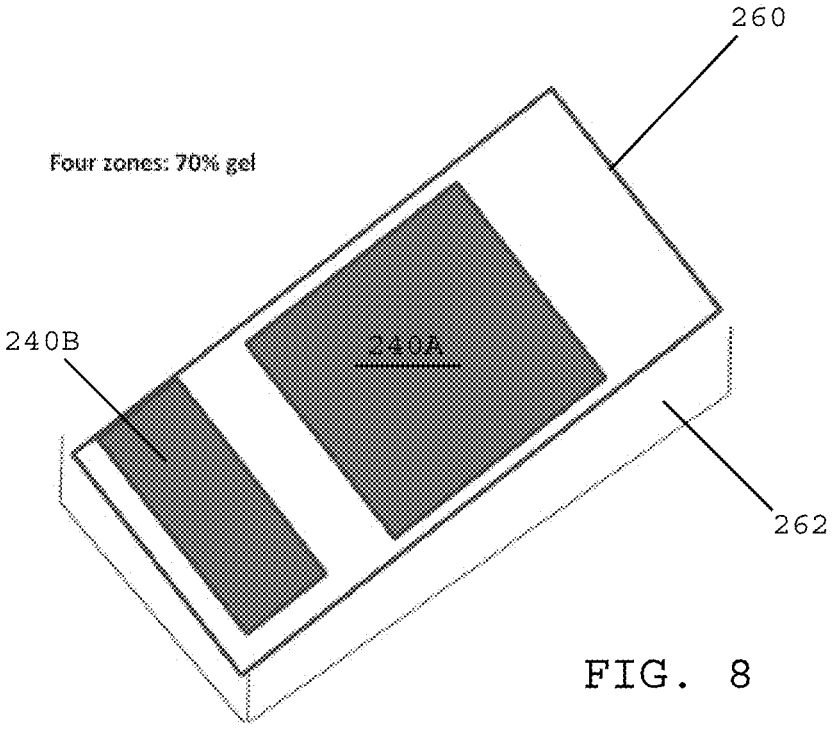
FIG. 8 shows a bedding product including a pair of flexible gel panels that cover about 70% of a top surface of a mattress, in accordance with one embodiment of the present invention.

Referring to FIG. 8, in one embodiment, a sleep product 260, such as a mattress topper, may have four zones whereby two of the zones of a mattress 262 are covered by a pair of flexible gel panels 240A, 240B.

Figure 9:
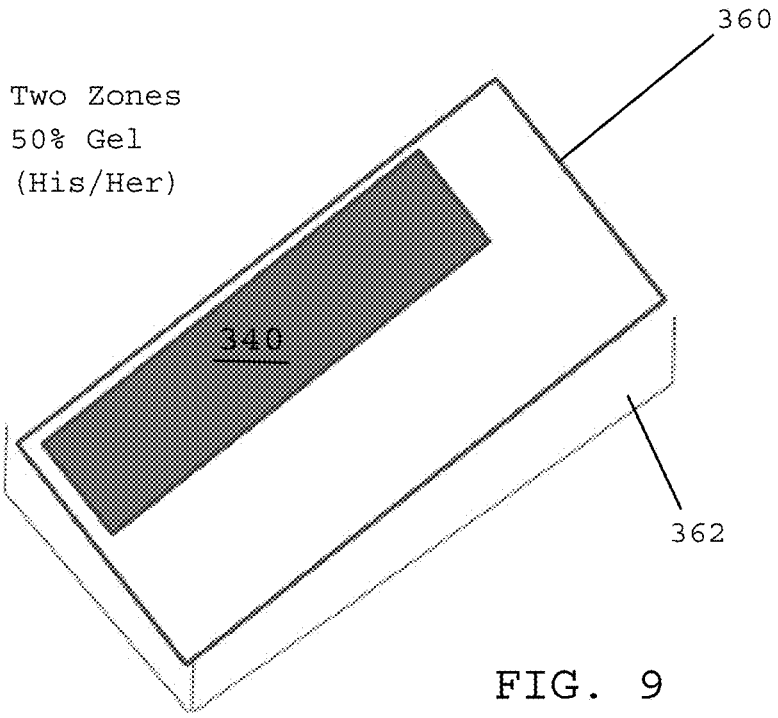
FIG. 9 shows a bedding product including a flexible gel panel that covers one half of a mattress, in accordance with one embodiment of the present invention.

Referring to FIG. 9, in one embodiment, a sleep product 360, such as a mattress topper, may have two zones (e.g. his/her) whereby only one of the zones of a mattress 362 is covered by a flexible gel panel 340.

In FIGS. 6-9, the mattresses are not shown to scale, and the mattresses are not inclined mattresses as they may appear to be in FIGS. 6-9. In the embodiments of FIGS. 6-9, the flexible gel panels may be incorporated into bedding products that are positioned over mattresses, such as flat sheets, fitted sheets, mattress toppers and mattress protectors.

Figure 10A:
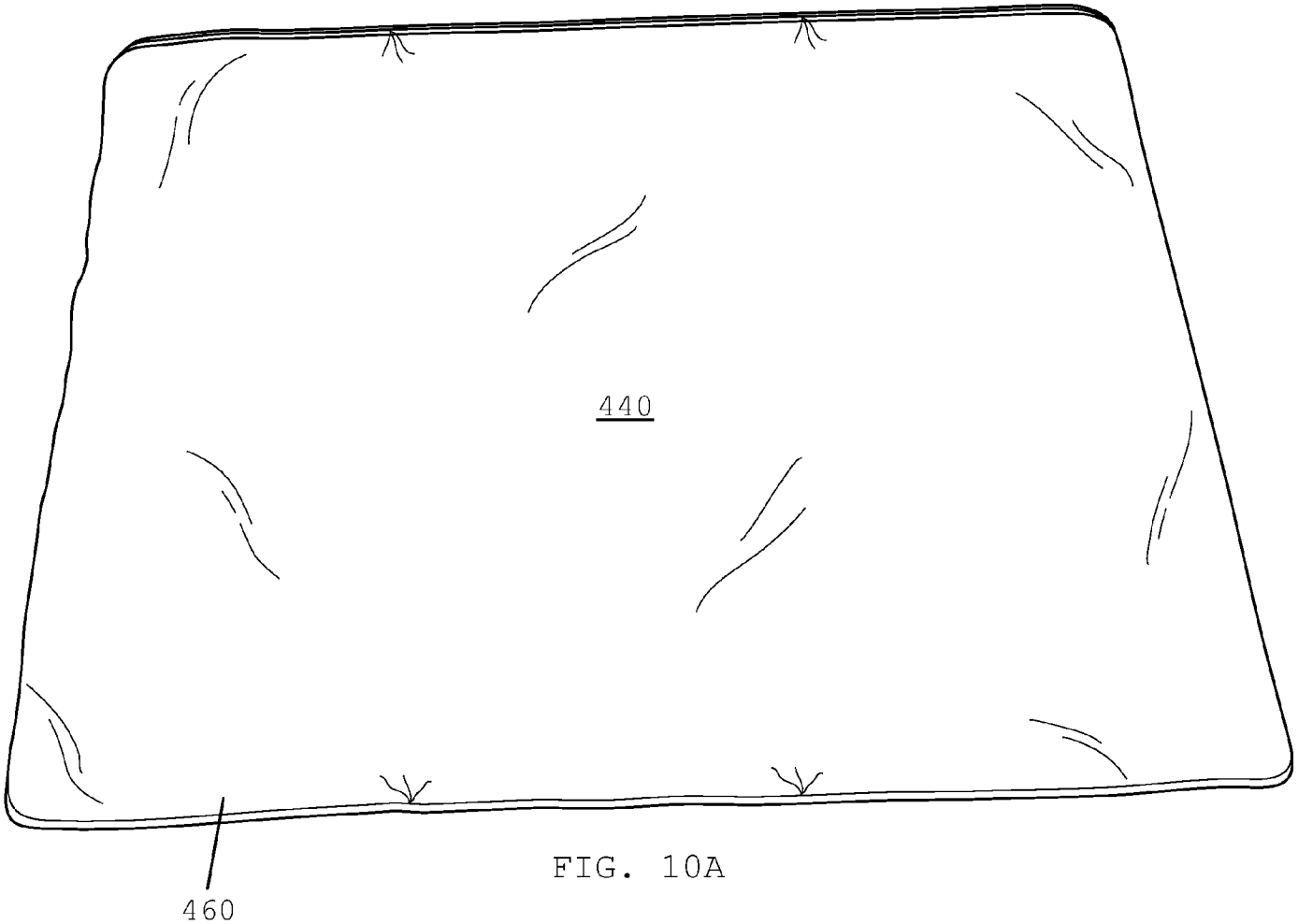
FIGS. 10A-10C show a pillow case having a flexible gel panel incorporated into one of the major panels of the pillow case, in accordance with one embodiment of the present invention.
Figure 10B:
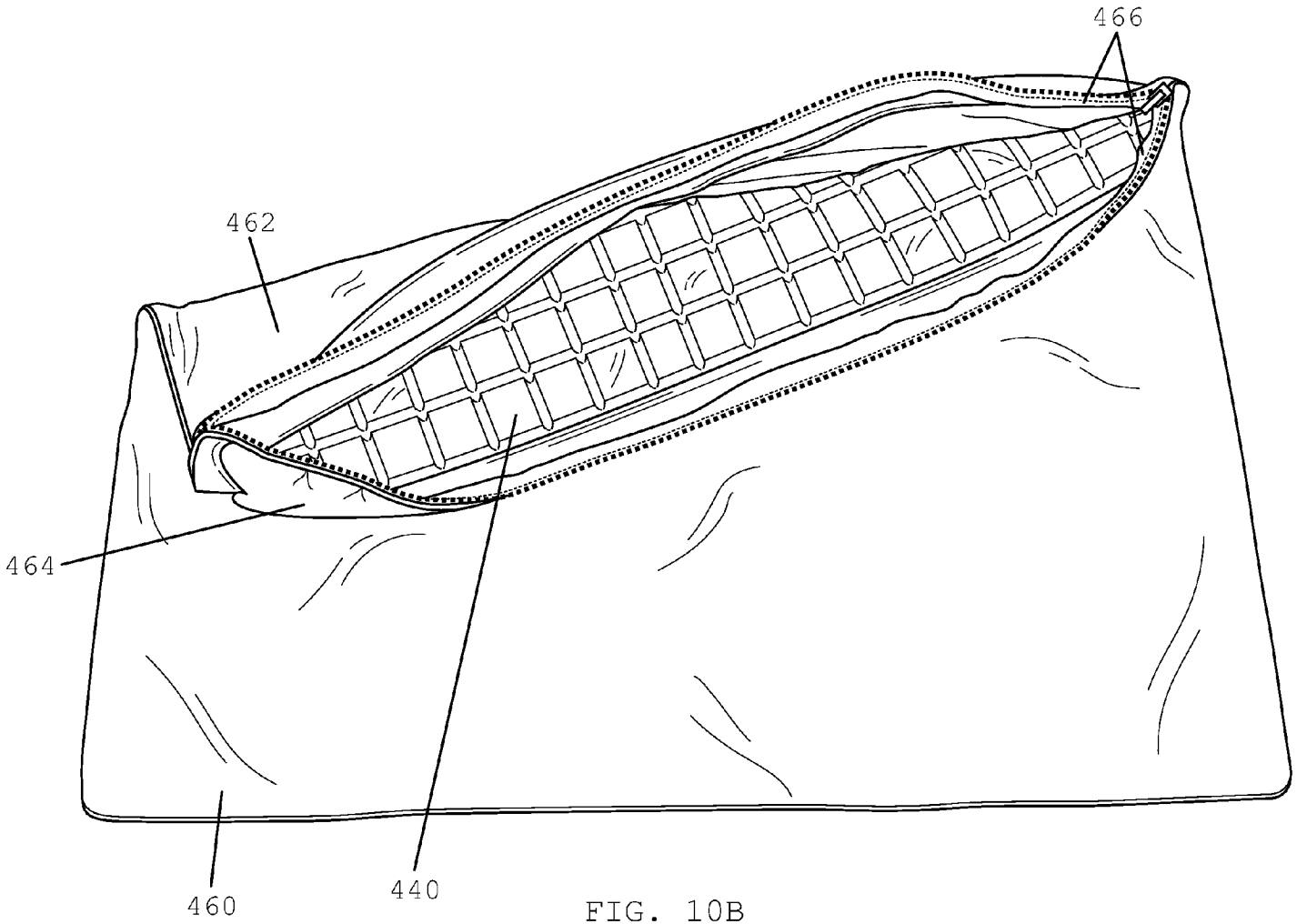
Figure 10C:
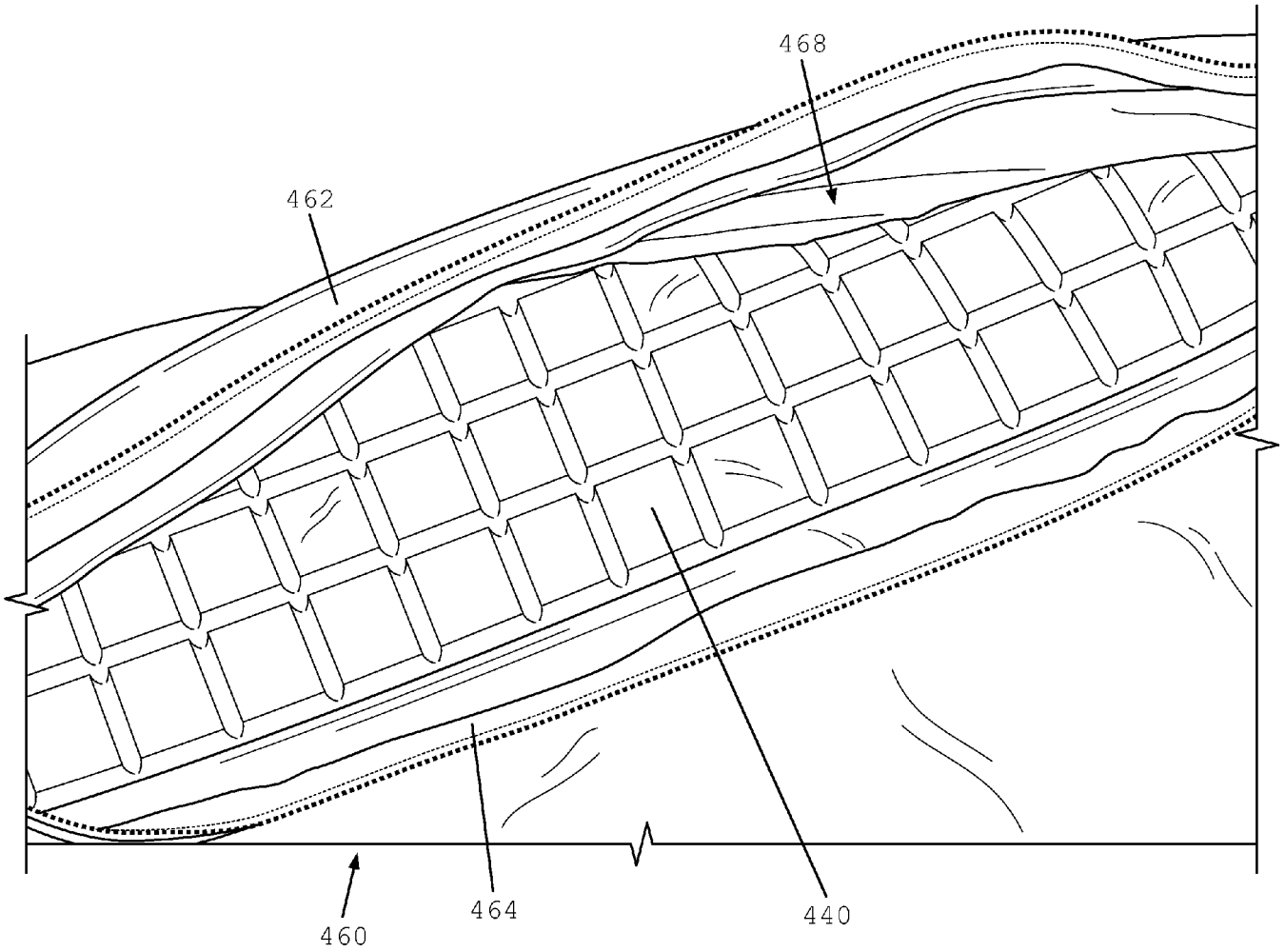

Referring to FIGS. 10A-10C, in one embodiment, a pillow case 460 has a flexible gel panel 440 incorporated into at least one of the major panels of the pillow case. The flexible gel panel 440 is manufactured and has similar properties as the flexible gel panels disclosed herein.

Referring to FIG. 10B, in one embodiment, the pillow case 460 has a first major panel 462 and a second major panel 464, which are sewn together around three sides of the respective first and second major panels. The fourth sides of the respective first and second major panels 462, 464 are not sewn together to define a pillow case opening, which may be closed using a fastener such as a zipper 466. Although a zipper 466 is shown, other fastening elements may be used, such as buttons, hook and loop fasteners, etc. In one embodiment, a flexible gel panel 440 is preferably incorporated (e.g., sewn) into the second major panel 464 of the pillow case 460. In one embodiment, a first flexible gel panel is incorporated into the first major panel 462 of the pillow case 460 and a second flexible gel panel is incorporated into the second major panel 464 of the pillow case 460.

FIG. 10C shows a magnified view of the flexible gel panel 440 incorporated into the second major panel 464 of the pillow case 460. The pillow case 460 has an opening 468 that extends between the first major panel 462 and the second major panel 464. A pillow may be passed through the opening 468 for placing the pillow inside the pillow case 460. The zipper 466 may be closed for securing the pillow inside the pillow case 460.

Figure 11:
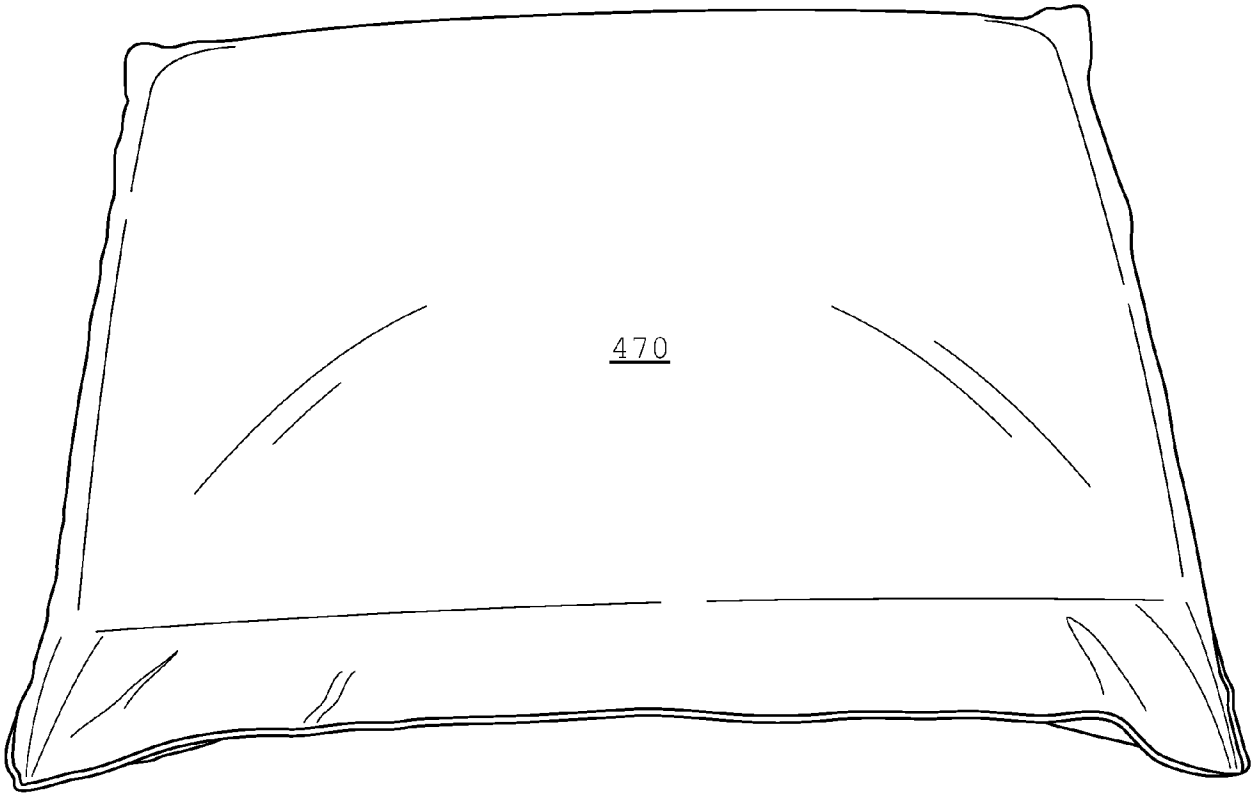
FIG. 11 shows a pillow insertable into the pillow case of FIGS. 10A-10C, in accordance with one embodiment of the present invention.

Referring to FIG. 11, in one embodiment, a pillow 470, such as a memory foam pillow, may be inserted into the pillow case 460 shown and described above in FIGS. 10A-10C. The pillow 470 may be made of a wide range of materials conventionally used for making pillows. In one embodiment, the pillow 470 may comprise memory foam. In one embodiment, the pillow may comprise memory foam and gel, such as a gel layer accessible at a major face of the pillow.

Figure 12A:
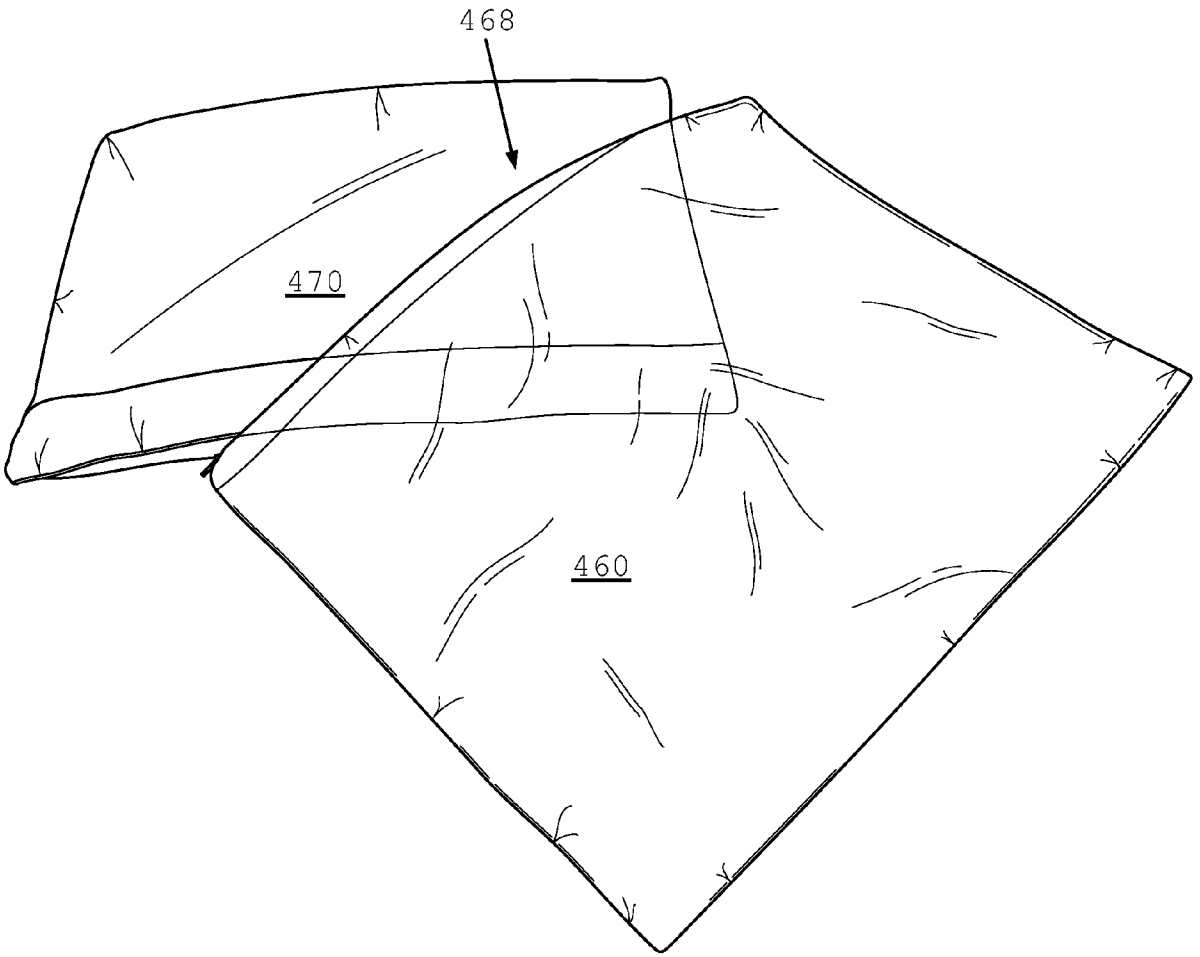
FIGS. 12A-12D show a method of placing the pillow of FIG. 11 inside the pillow case with the flexible gel panel of the FIGS. 10A-10C, in accordance with one embodiment of the present invention.
Figure 12B:
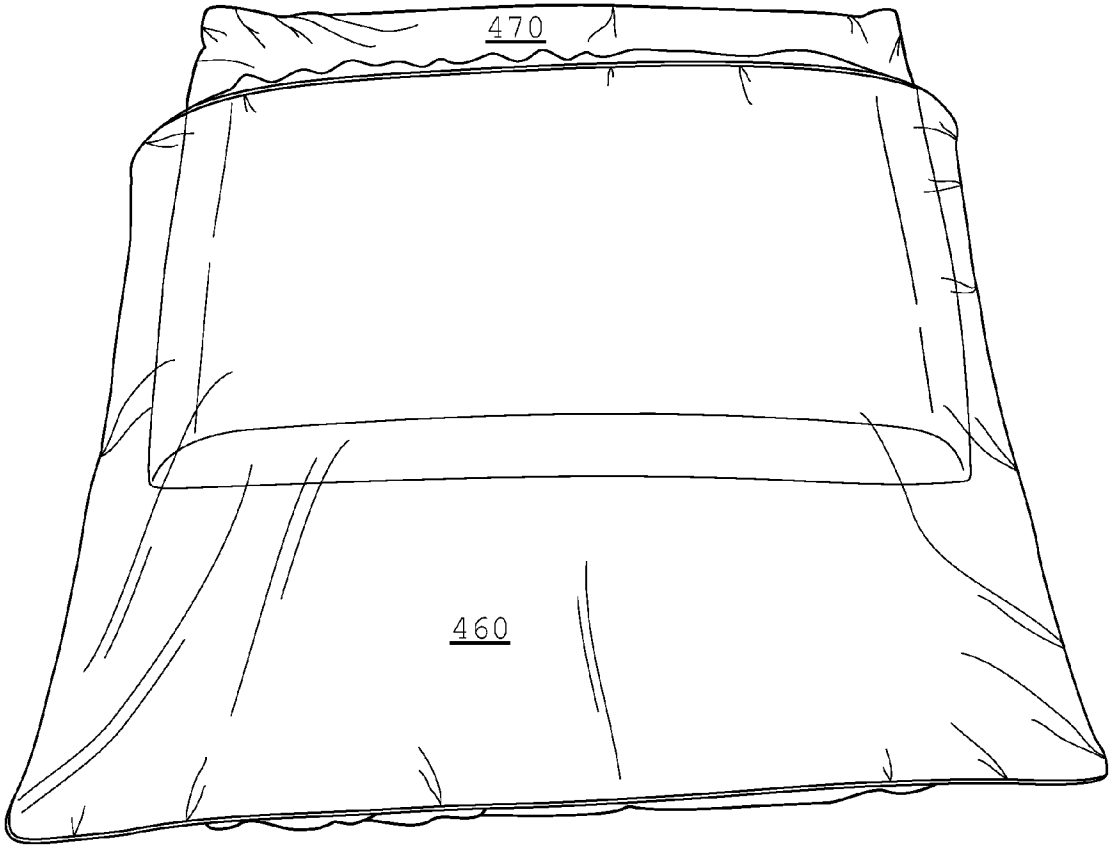

Referring to FIG. 12A, in one embodiment, the pillow 470 is passed through the opening 468 of the pillow case 460. FIG. 12B shows the pillow 470 after it has been further inserted into the pillow case 460.

Figure 12C:
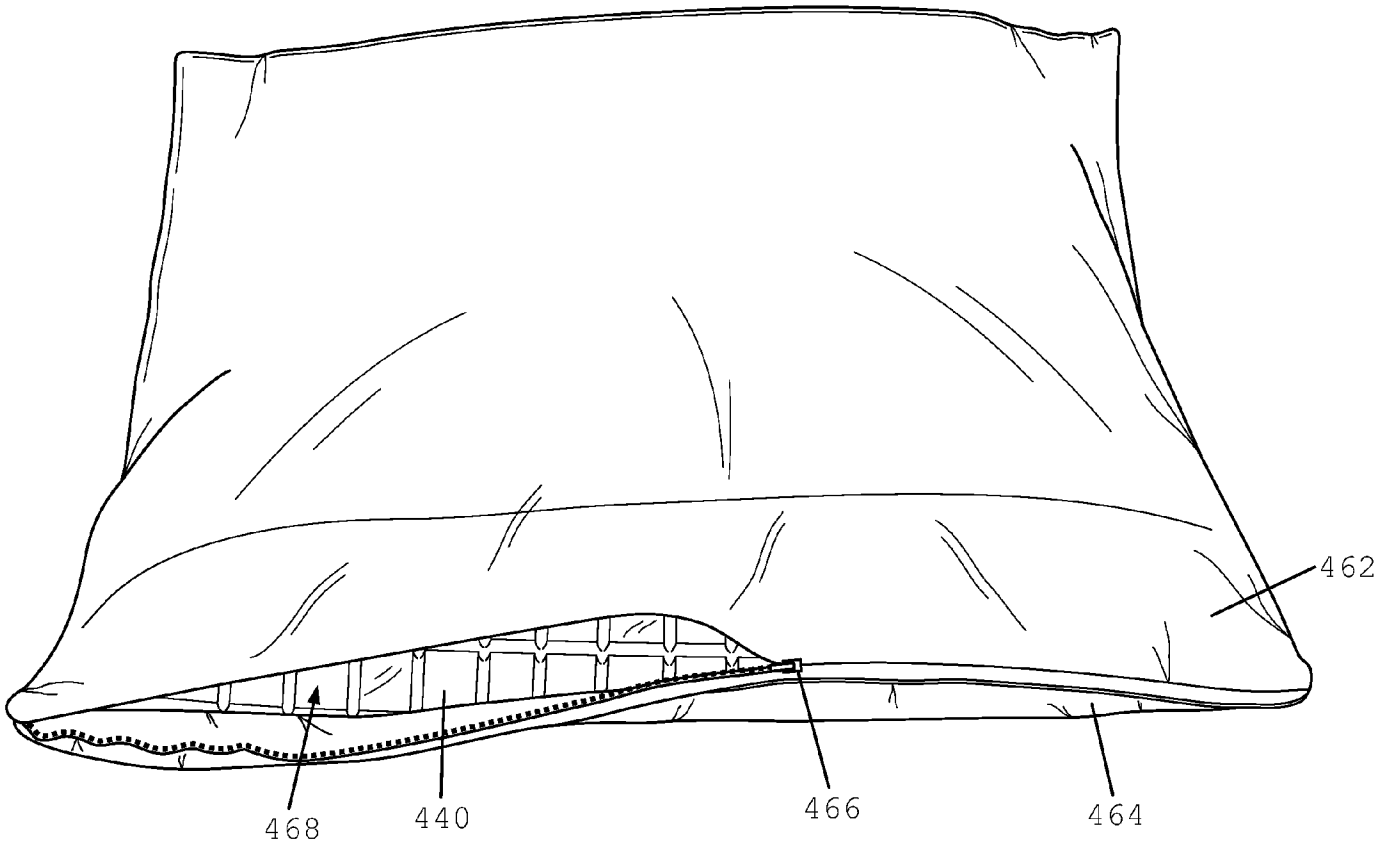

Referring to FIG. 12C, after the pillow 470 has been fully inserted into the opening 468 between the first and second major panels 462, 464, the zipper 466 may be pulled closed for closing the pillow case opening 468 and securing the pillow within the pillow case 460. As shown in FIG. 12C, the flexible gel panel 440 that is incorporated into the second major panel 464 of the pillow case 460 is juxtaposed with a major face of the pillow 470 (FIG. 12B).

Figure 12D:
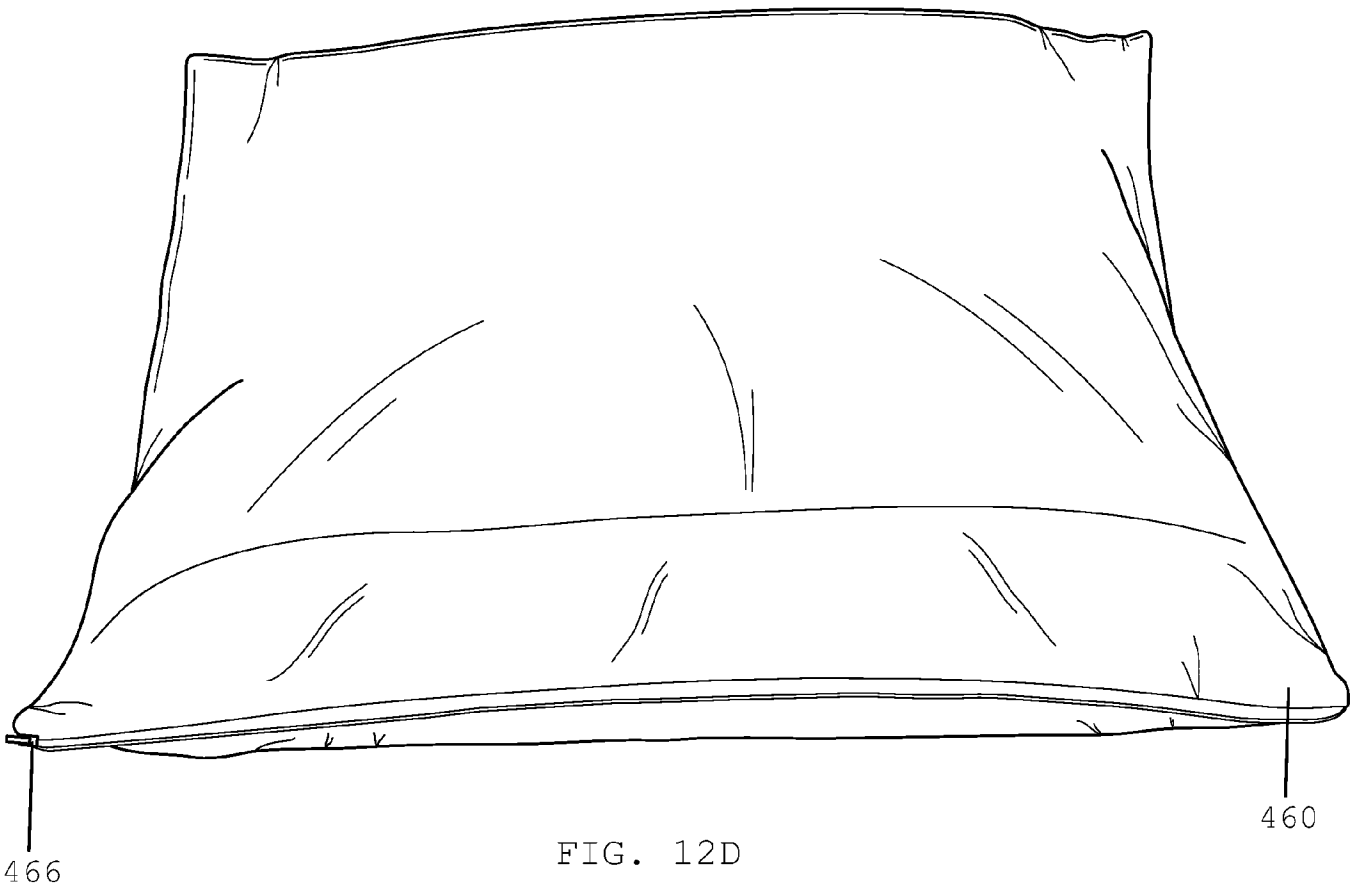
Figure 12E:
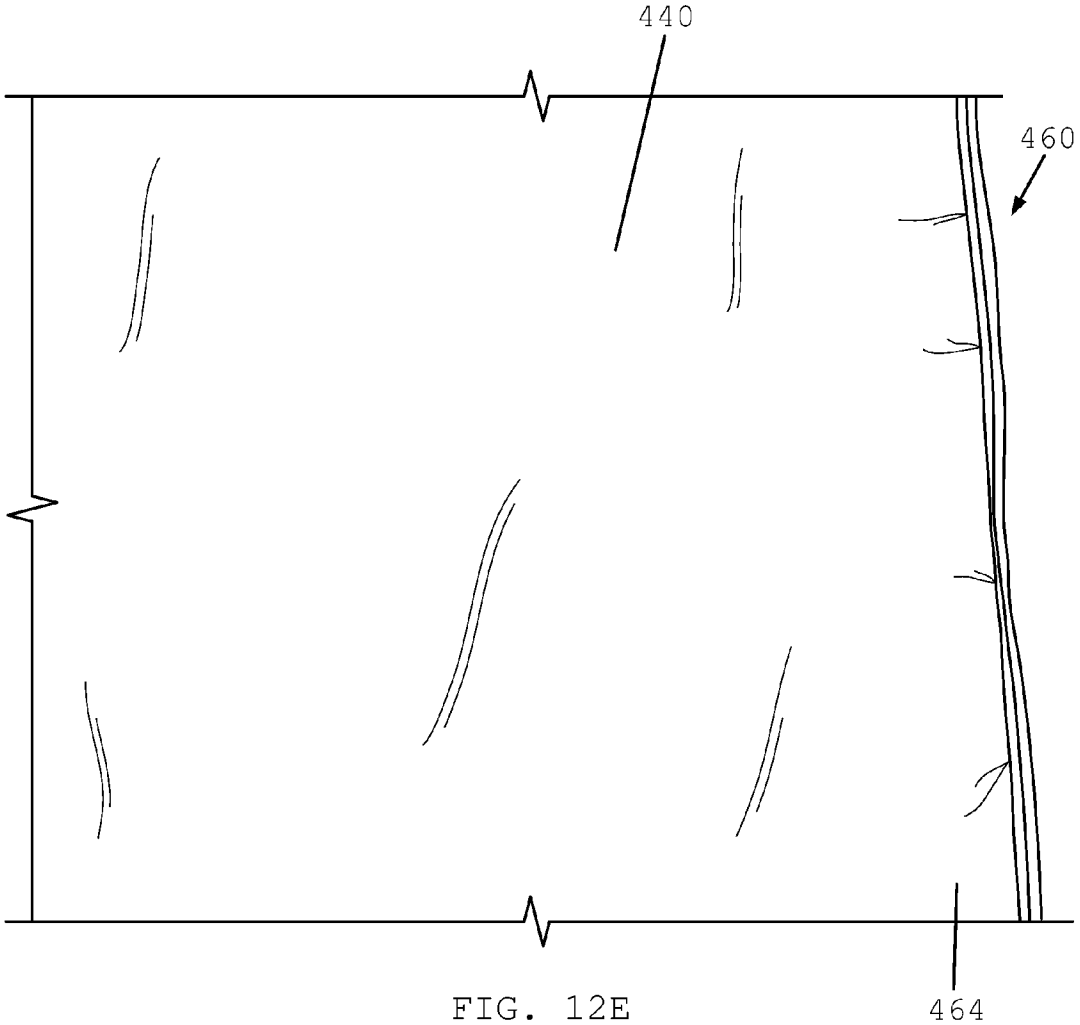
FIG. 12E shows a magnified view of a major face of the pillow case of FIG. 12D including a flexible gel layer incorporated into a major panel of the pillow case, in accordance with one embodiment of the present invention.

FIG. 12D shows pillow case 460 after the zipper 466 has been fully closed. FIG. 12E shows a magnified view of a section of the pillow case with the pillow secured within the pillow case. The flexible gel layer 440 incorporated into the second major panel 464 of the pillow case 460 overlies a major face of the pillow. In use, an individual places his or her head atop the flexible gel panel to obtain the cooling effect provided by the flexible gel panel 440.

Example 1

Various sleep products were tested to determine how long it took for the products to warm to certain temperature levels and to record the maximum temperature for each of the sleep products. As documented below, during use, sleep products having flexible gels or flexible gel pads incorporated therein take longer to warm, and may take up to 5.5 times longer to warm to certain temperature levels when compared to sleep products in which gels are not utilized.

Each of eight submitted samples was subjected to a temperature monitoring test. The eight submitted samples were as follows:

| Key | Sample Description |
|---|---|
| Sample 1 | Foam/Gel Pillow (blue side up) |
| Sample 2 | Cool Foam Pillow (blue side up) |
| Sample 3 | Foam w/o Ventilation Pillow |
| Sample 4 | foam w/Ventilation Pillow |
| Sample 5 | Latex Pillow |
| Sample 6 | Fiber Pillow |
| Sample 7 | Down Pillow |
| Sample 8 | Gel Infused Memory Foam |

Each sample was subjected to a temperature monitoring test whereby a thermocouple was placed in the following locations of the samples: the center of the top surface, at the point of heat application; the center of the bottom surface; the center of the interior (embedded in filling); and the outer edge. An electronic heating pad was placed in the center of each sample. The electronic heating pad was made in China and was distributed by Kaz, Inc. model number HP750. The heating pad was set to the temperature setting that maintained a temperature of 90° F.+/5° (32° C.+/−3°). A weight of 20 lbs. was placed on the heating pad. The temperature at each thermocouple was monitored for 90 minutes, with a reading taken every 30 seconds. The electronic heating pad was removed for the last 30 minutes of the test. During the test, a thermal image of each sample was taken at 10 minute intervals. The test results for each sample are provided in the charts below.

Results of Temperature Readings at Top of Samples

| | Sample 1 | Sample 2 | Sample 3 | Sample 4 | Sample 5 | Sample 6 | Sample 7 | Sample 8 |
|---|---|---|---|---|---|---|---|---|
| Maximum Temp (° C.) | 40.7 | 46.2 | 47.1 | 49.2 | 47.4 | 48.1 | 48.4 | 49.6 |
| Time To Max Temp (min) | 60.0 | 11.5 | 11.5 | 11.5 | 11.0 | 9.5 | 11.0 | 11.5 |
| Minimum Temp (° C.) | 24.4 | 24.6 | 23.3 | 23.2 | 24.3 | 22.9 | 23.5 | 23.7 |
| Average Temp (° C.) | 36.0 | 37.0 | 35.9 | 38.8 | 36.5 | 37.0 | 37.3 | 36.4 |

Results of Temperature Readings at Bottom of Samples

| | Sample 1 | Sample 2 | Sample 3 | Sample 4 | Sample 5 | Sample 8 | Sample 7 | Sample 8 |
|---|---|---|---|---|---|---|---|---|
| Maximum Temp (° C.) | 24.2 | 24.9 | 25.3 | 24.9 | 26.1 | 25.4 | 27.4 | 24.2 |
| Minimum Temp (° C.) | 22.1 | 23.8 | 23.7 | 23.8 | 23.7 | 23.1 | 23.7 | 22.5 |
| Average Temp (° C.) | 23.3 | 24.3 | 24.6 | 24.4 | 25.0 | 24.7 | 26.4 | 23.6 |

Results of Temperature Readings at Interior of Samples

| | Sample 1 | Sample 2 | Sample 3 | Sample 4 | Sample 5 | Sample 6 | Sample 7 | Sample 8 |
|---|---|---|---|---|---|---|---|---|
| Maximum Temp (° C.) | 27.7 | 25.3 | 27.4 | 25.8 | 28.6 | 31.8 | 30.0 | 28.4 |
| Minimum Temp (° C.) | 22.4 | 23.6 | 23.1 | 22.8 | 24.0 | 22.6 | 23.0 | 22.4 |

-continued

Results of Temperature Readings at Interior of Samples

| | Sample 1 | Sample 2 | Sample 3 | Sample 4 | Sample 5 | Sample 6 | Sample 7 | Sample 8 |
|---|---|---|---|---|---|---|---|---|
| Average Temp (° C.) | 26.3 | 24.6 | 26.0 | 24.7 | 27.4 | 29.6 | 28.3 | 26.6 |

Results of Temperature Readings at Interior of Samples

| | Sample 1 | Sample 2 | Sample 3 | Sample 4 | Sample 5 | Sample 6 | Sample 7 | Sample 8 |
|---|---|---|---|---|---|---|---|---|
| Maximum Temp (° C.) | 24.2 | 24.2 | 24.0 | 24.4 | 24.1 | 24.3 | 24.1 | 23.8 |
| Minimum Temp (° C.) | 22.5 | 22.3 | 22.0 | 22.4 | 22.6 | 22.4 | 22.6 | 22.5 |
| Average Temp (° C.) | 23.1 | 22.9 | 23.0 | 23.2 | 23.1 | 22.8 | 23.2 | 23.2 |

Based on the resting results, Sample 1—the Foam/Gel Pillow sample, exhibited the lowest thermal conductivity properties compared to all of the other samples evaluated. Under the same heat load conditions (which simulated actual use), it took the Foam/Gel Pillow (gel side up) approximately 5.5 times longer to reach its maximum temperature, and its maximum temperature, was on average, 7° C. lower than the other samples evaluated.

While the foregoing is directed to embodiments of the present invention, other and further embodiments of the invention may be devised without departing from the basic scope thereof, which is only limited by the scope of the claims that follow. For example, the present invention contemplates that any of the features shown in any of the embodiments described herein, or incorporated by reference herein, may be incorporated with any of the features shown in any of the other embodiments described herein, or incorporated by reference herein, and still fall within the scope of the present invention.

What is claimed is:

1. A bedding product comprising:

a flexible gel panel having a length and a width defining a perimeter, said flexible gel panel including a cured gel layer having a top surface and a bottom surface, a flexible top layer overlying and bonded to said top surface of said cured gel layer to form a top exterior surface of said flexile gel panel, and a fabric bottom layer overlying and bonded to said bottom surface of said cured gel layer to form a bottom exterior surface of said flexible gel panel, wherein said cured gel layer has a wave configuration including thicker gel sections that are connected to one another by thinner gel filled valleys, wherein said thicker gel sections and said thinner gel filled valleys cooperate to form a continuous cured gel layer that extends continuously within the perimeter of said flexible gel panel; and wherein said flexible top layer and said fabric bottom layer are continuously separated from one another by said continuous cured gel layer that extends continuously within the perimeter of said flexible gel panel; and said bedding product having a major surface, wherein said flexible gel panel is integrated into said bedding product so that said flexible top layer of said flexible gel panel is juxtaposed with said major surface of said bedding product.

2. The bedding product as claimed in claim 1, wherein said flexible top layer of said flexible gel panel comprises a clear film.

3. The bedding product as claimed in claim 1, wherein said flexible top layer of said flexible gel panel comprises a polyurethane film.

4. The bedding product as claimed in claim 1, wherein said flexible top layer of said flexible gel panel comprises a TPU film.

5. The bedding product as claimed in claim 1, wherein said fabric bottom layer comprises a flexible fabric, and wherein said gel layer spaces said flexible fabric from said flexible top layer at said gel filled valleys.

6. The bedding product as claimed in claim 5, wherein said flexible fabric comprises a stretchable fabric.

7. The bedding product as claimed in claim 1, wherein said fabric bottom layer comprises a phase change fabric.

8. The bedding product as claimed in claim 1, wherein said fabric bottom layer comprises a lightweight fabric or a mesh fabric.

9. The bedding product as claimed in claim 1, wherein said flexible top layer is bonded to said top surface of said cured gel layer extends continuously within the perimeter of said flexible gel panel and said fabric bottom layer bonded to said bottom surface of said cured gel layer extends continuously within the perimeter of said flexible gel panel, wherein said thicker gel sections comprise gel tubes that are connected to one another by said gel filled valleys that extend between said gel tubes to cooperatively form said continuous cured gel layer having the wave configuration.

10. The bedding product as claimed in claim 1, wherein said flexible gel panel has a length of about 60-90 inches, a width of about 30-80 inches and a thickness of about 1-10 mm.

11. The bedding product as claimed in claim 1, wherein said bedding product comprises a pillow case having a major surface and said flexible gel panel is juxtaposed with said major surface of said pillow case.

12. The bedding product as claimed in claim 11, wherein said flexible gel panel is secured to said major surface of said pillow case.

13. The bedding product as claimed in claim 11, wherein said flexible gel panel is releaseably secured to said major surface of said pillow case.

14. The bedding product as claimed in claim 1, wherein said bedding product comprises a mattress topper having a major surface and said flexible gel panel is juxtaposed with said major surface of said mattress topper.

15. The bedding product as claimed in claim 14, wherein said flexible gel panel is releaseably secured to said major surface of said mattress topper.

16. The bedding product as claimed in claim 1, wherein said bedding product comprises a flexible fabric sheet having a major surface and said flexible gel panel is juxtaposed with said major surface of said flexible fabric sheet.

17. A bedding product comprising:

a flexible gel panel having a length and a width defining a perimeter, said flexible gel panel including a cured gel layer having a top surface and a bottom surface, a clear, flexible top layer overlying and bonded to said top surface of said cured gel layer to form a top exterior surface of said flexible gel panel, and a stretchable fabric bottom layer overlying and bonded to said bottom surface of said cured gel layer to form bottom exterior surface of said flexible gel panel, wherein said cured gel layer has a wave configuration including thicker gel sections that are connected to one another by thinner gel filled valleys, wherein said thicker gel sections and said thinner gel filled valleys cooperate so that said cured gel layer extends continuously within the perimeter of said flexible gel panel for separating said flexible top layer and said fabric bottom layer;

a pillow case having a major face, wherein said clear, flexible top layer of said flexible gel panel is juxtaposed with said major face of said pillow case.

18. The bedding product as claimed in claim 17, further comprising one or more fasteners for releasably securing said flexible gel panel to said pillow case.

19. A bedding product comprising:

a flexible gel panel having a length and a width defining a perimeter, said flexible gel panel including a cured gel layer having a top surface and a bottom surface, a clear, flexible top layer overlying said top surface of said cured gel layer, and a stretchable fabric bottom layer overlying said bottom surface of said cured gel layer, wherein said cured gel layer has a wave configuration including thicker gel sections that are connected to one another by thinner gel filled valleys, wherein said thicker gel sections and said thinner gel filled valleys cooperate so that said cured gel layer extends continuously within the perimeter of said flexible gel panel for separating said flexible top layer and said fabric bottom layer;

a mattress topper having a major face, wherein said clear, flexible top layer of said flexible gel panel is juxtaposed with said major face of said mattress topper.

20. The bedding product as claimed in claim 19, further comprising one or more fasteners for releasably securing said flexible gel panel to said mattress topper.

* * * * *